US005702865A

United States Patent [19]

Simons

[11] Patent Number: 5,702,865

[45] Date of Patent: Dec. 30, 1997

[54] METHOD OF FORMING PHOTOGRAPHIC RELIEF IMAGES

[75] Inventor: Michael John Simons, Ruislip, United Kingdom

[73] Assignee: Eastman Kodak Company, Rochester, N.Y.

[21] Appl. No.: 728,584

[22] Filed: Oct. 10, 1996

[30] Foreign Application Priority Data

Oct. 12, 1995 [GB] United Kingdom ..... 9520918

[51] Int. Cl.[6] ..... G03C 5/315; G03C 5/30

[52] U.S. Cl. ..... 430/264; 430/442; 430/484; 430/566

[58] Field of Search ..... 430/442, 484, 430/566, 264, 255

[56] References Cited

U.S. PATENT DOCUMENTS 4,258,120 3/1981 Gerbal et al. ..... 430/223

4,447,523 5/1984 Ross et al. ..... 430/551

4,699,868 10/1987 Sabongi ..... 430/484

5,230,981 7/1993 Saito et al. ..... 430/264

5,455,155 10/1995 Brick et al. ..... 430/566

*Primary Examiner*—Richard L. Schilling

*Attorney, Agent, or Firm*—J. Lanny Tucker

[57] ABSTRACT

Relief images can be formed in photographic elements having a tanning developing agent incorporated therein. The tanning developing agents have the formula:

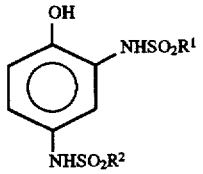

(I)

wherein $R^1$ and $R^2$ are each an alkyl group of at least 3 carbon atoms, or an aryl group.

After exposure, the material is treated with an alkaline solution and unhardened areas are removed.

6 Claims, No Drawings

METHOD OF FORMING PHOTOGRAPHIC RELIEF IMAGES

FIELD OF THE INVENTION

This invention relates to the formation of photographic relief images in photographic silver halide materials containing a tanning developing agent.

BACKGROUND OF THE INVENTION

Gelatin matrix images (relief images) are used in a variety of areas that include the formation of printing plates, copy and, image setter graphic arts materials and dye imbibition products.

The usual way of using a silver halide to obtain a relief image is to use a developer solution that hardens the gelatin in the developable image areas by using a tanning developer. Typical of such a tanning developing agent would be pyrogallol or catechol.

In such a process the silver halide material would be imagewise exposed, developed in a tanning developer solution and washed with warm water to wash off the unexposed areas and leave the exposed areas as a tanned relief image.

A problem with such known tanning developing agents is that they are very susceptible to aerial oxidation when in alkaline solution that can lead to brown staining of the equipment and the skin of the operator. It is known to incorporate tanning developing agents in a silver halide coating and 4-phenylcatechol has been used for this purpose. Compounds like 4-phenylcatechol are poorly ballasted and are prone to leach out of the coating into the processing solution where staining can occur, or to leach into the skin when the coating is handled, with possible harmful effects.

It is noted that compounds of formula (III) below have been used commercially as interlayer oxidized developing agent scavengers in color negative films. Their ability to act as a tanning developer has not hitherto been recognized.

SUMMARY OF THE INVENTION

According to the present invention there is provided a method of forming a relief image comprising:

A) imagewise exposing a photographic silver halide material that comprises a support bearing at least one silver halide emulsion and, having incorporated in the emulsion layer or a layer adjacent thereto a tanning developing agent of the formula I:

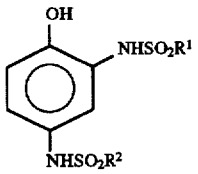

(I)

wherein $R^1$ and $R^2$ are each an alkyl group of at least 3 carbon atoms, or an aryl group, B) treating the material with an alkaline solution having a pH greater than 9, thereby hardening developing areas of the material, and C) treating the material with an aqueous medium to remove unhardened areas.

The problem solved is that tanning development may be achieved without staining and with reduced chance of the developing agent coming into contact with the skin. The developing agents of the invention also give unusually good keeping characteristics for developer-incorporated materials.

Usually the unhardened areas of the material will be removed by washing with water at a temperature above 25° C. The compounds of formulae (I) and (II) are particularly stable when incorporated into a photographic material and formation of stain is very significantly reduced.

DETAILED DESCRIPTION OF THE INVENTION

In general, in formula (I), optional substituents on either the aryl or alkyl group may be amide, sulfonamide, ether and ester groups.

A preferred group of tanning developing agents has the formula II:

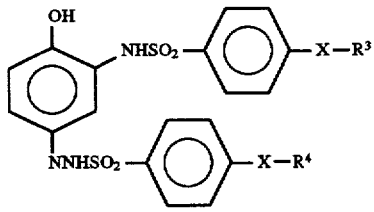

(II)

wherein X is a linking group such as —NH—, —O—, —S—, —NHCO— or —$CH_2$—, and $R^3$ and $R^4$ are each a straight or branched chain alkyl group of 1 to 18 carbon atoms, and preferably of 6 to 18 carbon atoms.

Preferably, $R^1$ and $R^2$ have the formula:

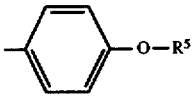

wherein $R^5$ is an alkyl group of 6 to 18 carbon atoms. Preferably, $R^5$ is an alkyl group of 6 to 18 carbon atoms, for example the group —$C_{12}H_{25}$.

Examples of substituent groups that may be present on $R^1$ and $R^2$ are alkyl, alkoxy, halide, carbonamide, sulfonamide, carbamoyl, sulfamoyl, amino, ether and ester groups.

Examples of $R^3$ and $R^4$ are n-hexyl, n-decyl, n-hexadecyl, 2-ethylhexyl, t-hexyl, sec-octyl or t-octyl.

The alkaline solution preferably has a pH in the range of 9 to 14 (preferably of 10 to 12.5) and may be buffered, e.g., with a phosphate or carbonate.

The developer solution may contain an auxiliary developing agent, for example, a p-aminophenol or a pyrazolidinone. Examples of pyrazolidinone developing agents are: 4-methyl-1-phenylpyrazolidinone, 4-hydroxymethyl-4-methyl-1-phenylpyrazolidinone or any of those listed in *Research Disclosure* Item 36544, September 1994, published by Kenneth Mason Publications, Emsworth, Hants, United Kingdom. This publication will be referred to simply as *Research Disclosure* below.

The alkaline solution may also contain development restrainers (antifoggants), for example, bromide ions or a nitrogen-containing heterocyclic compound or a mercapto group-containing compound.

Many developer solution components, which may be used in the present invention, are listed in *Research Disclosure*, section XIX.

The photographic material may be on a film or paper base including any of the supports described in *Research Disclosure* Section XVII and the references described therein.

The silver halide materials having incorporated compounds of Formula (I) may be used to make gelatin matrix images, dye transfer images, lithographic printing plates and graphic arts copy preparation and image setter films or papers.

The photographic materials may comprise silver chloride, silver bromide, silver iodide, or mixtures thereof such as silver bromochloride, silver iodobromide or silver chloroiodobromide and may be spectrally sensitized.

The photographic materials useful in this invention or individual layers thereof, can contain compounds that absorb the radiation used to expose them in order to reduce light scatter.

The photographic or individual layers thereof may also contain substances to increase the density of the residual image in a desired spectral band. For instance, graphic arts, copy preparation and image setter films are frequently desired to have a high image density to UV radiation. In such cases a UV-absorbing compound may be incorporated in the coating.

Examples of UV-absorbers that may be used are

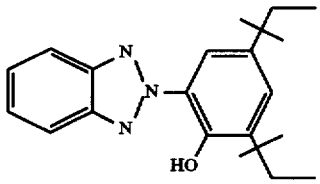

and

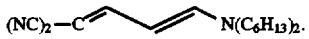

The silver halide emulsion employed in the photographic elements can be either negative- working or positive-working. Suitable emulsions and their preparation are described in *Research Disclosure* Sections I and II and the publications cited therein. Suitable vehicles for the emulsion layers and other layers of elements of this invention are described in *Research Disclosure* Section IX and the publications cited therein.

The photographic elements or individual layers thereof can contain brighteners (see *Research Disclosure* Section V), antifoggants and stabilizers (see *Research Disclosure* Section VI), antistain agents and image dye stabilizer (see *Research Disclosure* Section VII, paragraphs I and J), light absorbing and scattering materials (see *Research Disclosure* Section VIII), hardeners (see *Research Disclosure* Section X), plasticizers and lubricants (see *Research Disclosure* Section XII), antistatic agents (see *Research Disclosure* Section XIII), matting agents (see *Research Disclosure* Section XVI) and development modifiers (see *Research Disclosure* Section XXI).

The following Examples are included for a better understanding of the invention.

EXAMPLE 1

A coating was prepared by coating an aqueous composition having 4% w/v gelatin onto cellulose triacetate film base to give the stated coated laydowns in g/m$^2$:

| | |
|---|---|
| Gelatin | 2.0 |
| Blue-sensitive emulsion | 1.0 |
| Developer Structure III | 0.6 |

The blue-sensitive emulsion was a silver bromoiodide photographic emulsion of the tabular grain type, containing 1% iodide, the grains having a mean equivalent circular diameter of 0.52 μm and a mean thickness of 0.09 μm. 1.5 g of 4-hydroxy-6-methyl-1,3,3a,7-tetraazaindene was added per mole of silver halide.

The developing agent having the structure:

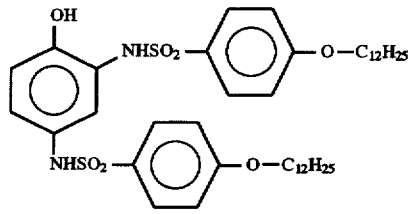

(III)

was incorporated as a normal photographic dispersion, using diethyl lauramide as the oil-forming solvent.

A sample of the coated film was exposed through a pattern to white light, and developed for 90 sec in the following aqueous solution:

| | |
|---|---|
| $Na_3PO_4.12H_2O$ | 80 g/l |
| $Na_2SO_3$ | 80 |
| sorbitol | 10 |
| 4-hydroxymethyl-4-methyl-1-phenyl-3-pyrazolidone | 1.0 |
| NaBr | 4.0 |
| 6-nitrobenzimidazole | 0.04 |
| pH adjusted to 12.0 with dilute sulfuric acid | |

The sample was briefly dipped in 2% aqueous acetic acid solution as a stop bath, then washed under running tap water at about 40° C.

It was observed that the coating was washed off the film base in areas which had not developed, to leave clear film base. In areas which had developed, a dark relief image remained, and the edges of the image areas were observed to be sharp under the microscope.

EXAMPLE 2 (COMPARATIVE EXAMPLE)

Coatings were prepared as in Example 1, except one coating used dioctylhydroquinone (a ballasted hydroquinone developing agent) and the other used a ballasted hydrazide developing agent of the structure:

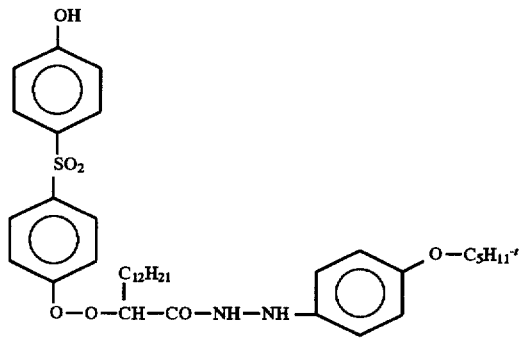

(IV)

in place of the developing agent used in Example 1. The coatings were then tested as in Example 1. In both cases a dark image developed, but it washed off in the warm water, showing that tanning development was not achieved.

EXAMPLE 3

A coating was prepared by coating an aqueous composition having 4% w/v gelatin onto cellulose triacetate film base to give the stated coated laydowns in g/m$^2$:

| | |
|---|---|
| Gelatin | 1.5 |
| Red-sensitive emulsion | 0.5 |
| Developer Structure III | 0.6 |
| UV absorber | 0.3 |

The red-sensitive emulsion was a silver chlorobromide cubic emulsion, containing 70 mol % chloride and having a mean grain edge length of 0.18 mm. It was sulfur-gold sensitized and spectrally sensitized to the red region of the spectrum.

The developing agent was incorporated as a normal photographic dispersion as in Example 1. The UV absorber was an ultra-violet light absorbing compound of structure:

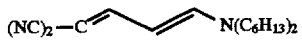

and was incorporated as a conventional photographic dispersion using 1,4-cyclohexane dimethylene-bis-2-ethyl hexanoate as the oil-forming solvent.

A sample of the coating was exposed to white light through a photographic step wedge. It was developed in the same solution as used in Example 1, but this time the developer was at a temperature of 48° C., and the development time was 10 sec followed immediately by 15 sec washing in warm water at about 40° C. after which it was dried.

Again, the undeveloped areas of the coating were observed to have washed away, but the developed areas were still present as a relief image of the step wedge. The white light or visual density of the image was 0.85 in the most exposed areas, but the density to UV radiation was 3.8, that is, greatly enhanced over the visible light density of the silver image, due to the presence of the UV absorber. The density of the background areas was 0.03 to white light and 0.07 to UV radiation.

The invention has been described in detail with particular reference to preferred embodiments thereof, but it will be understood that variations and modifications can be effected within the spirit and scope of the invention.

I claim:

1. A method of forming a relief image comprising:

A) imagewise exposing a photographic silver halide material that comprises a support bearing at least one silver halide emulsion and, having incorporated in the emulsion layer or a layer adjacent thereto a tanning developing agent of the formula:

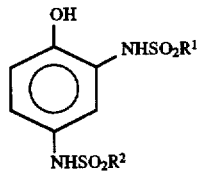

(I)

wherein $R^1$ and $R^2$ are each an alkyl group of at least 3 carbon atoms, or an aryl group, B) treating said material with an alkaline solution having a pH greater than 9, thereby hardening developing areas of said material, and C) treating said material with an aqueous medium to remove unhardened areas.

2. The method of claim 1 wherein $R^1$ and $R^2$ have the formula:

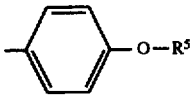

wherein $R^5$ is an alkyl group of 6 to 18 carbon atoms.

3. The method of claim 2 wherein $R^5$ is $—C_{12}H_{25}$.

4. The method of claim 1 wherein said tanning developing agent has the formula:

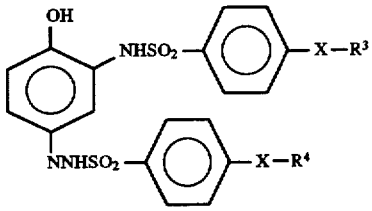

(II)

wherein X is the linking group —NH—, —O—, —S—, —NHCO— or $—CH_2—$, and $R^3$ and $R^4$ are each a straight or branched chain alkyl group of 1 to 18 carbon atoms.

5. The method of claim 4 wherein $R^3$ and $R^4$ are each a n-hexyl, n-decyl, n-hexadecyl, iso-hexyl, t-hexyl, 2-ethylhexyl or t-octyl.

6. The method of claim 1 wherein said photographic material further contains a visible light- or UV-absorbing compound.

* * * * *

UNITED STATES PATENT AND TRADEMARK OFFICE

CERTIFICATE OF CORRECTION

PATENT NO. : 5,702,865
DATED : 12/30/97
INVENTOR(S) : Michael J. Simons

It is certified that error appears in the above-identified patent and that said Letters Patent is hereby corrected as shown below:

Col 6, line 35, claim 4 delete the structure and replace therefor the following structure --

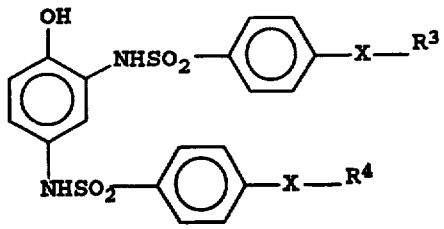

(II)

Signed and Sealed this

Seventeenth Day of March, 1998

Bruce Lehman

*Attest:*

BRUCE LEHMAN

*Attesting Officer*

*Commissioner of Patents and Trademarks*